United States Patent [19]

Laputka

[11] Patent Number: 4,847,926

[45] Date of Patent: Jul. 18, 1989

[54] SWIMMING POOL LINER RETAINING BRACKET

[75] Inventor: John T. Laputka, New York, N.Y.

[73] Assignee: Home & Roam Leisure Inc., Fairfield, N.J.

[21] Appl. No.: 48,384

[22] Filed: May 11, 1987

[51] Int. Cl.[4] ..... E04H 3/16; E04H 3/18

[52] U.S. Cl. ..... 4/506; 220/5 A; 248/220.1

[58] Field of Search ..... 4/506, 505, 510–513, 4/488; 52/36, 169.7, 169.14, 300, 245, 246; 248/300, 301, 220.1; 220/5 A, 18, 404, 410

[56] References Cited

U.S. PATENT DOCUMENTS

| | | | |
|---|---|---|---|
| 3,225,362 | 12/1965 | Barrera | 4/506 |
| 3,239,975 | 3/1986 | Stier . | |
| 3,268,917 | 8/1966 | Diemond et al. . | |
| 3,274,621 | 9/1966 | Diemond et al. . | |
| 3,518,705 | 7/1970 | Cudney . | |
| 3,745,593 | 7/1973 | Wall . | |
| 3,785,009 | 1/1974 | Greene | 4/506 |
| 3,785,099 | 1/1974 | Greene . | |
| 3,793,651 | 2/1974 | Pitti et al. . | |
| 3,854,268 | 12/1974 | Gutner | 248/220.1 |
| 3,955,220 | 5/1976 | Kessler | 4/506 |
| 4,062,158 | 12/1977 | Kaufman et al. . | |
| 4,625,471 | 12/1986 | Cheng | 52/36 |

FOREIGN PATENT DOCUMENTS

| | | | |
|---|---|---|---|
| 2178655 | 2/1987 | United Kingdom | 4/488 |

*Primary Examiner*—Stephen Marcus

*Attorney, Agent, or Firm*—Lerner, David, Littenberg, Krumholz & Mentlik

[57] ABSTRACT

A liner retaining bracket for an above-ground swimming pool is constructed and arranged for simultaneously and conjointly attaching the pool liner to the upper edge of a retaining wall and interlocking with an adjacent supporting upright. Use of the liner retaining bracket facilitates assembly of above-ground swimming pools while enhancing its structural integrity.

25 Claims, 4 Drawing Sheets

FIG. 3
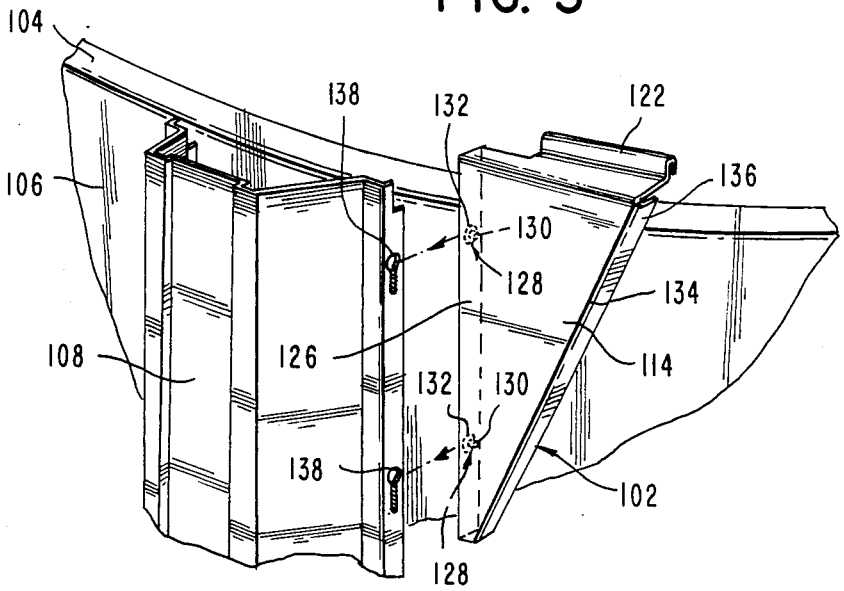
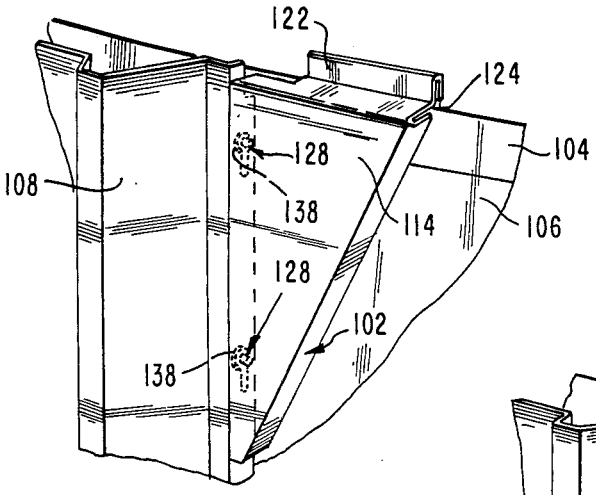
FIG. 4
FIG. 5
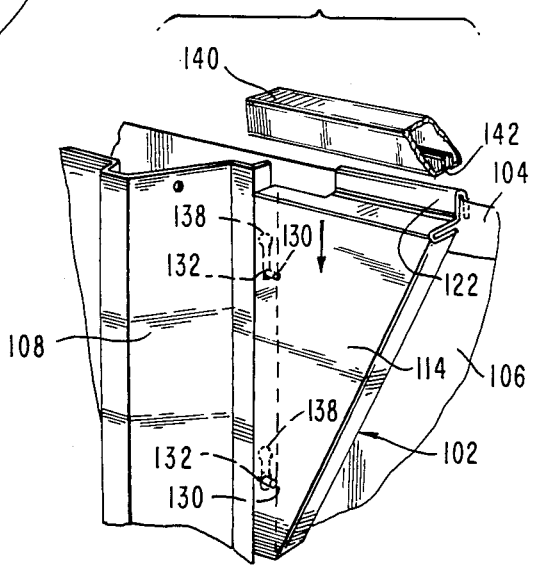

SWIMMING POOL LINER RETAINING BRACKET

BACKGROUND OF THE INVENTION

The present invention relates in general to an above-ground swimming pool including a retaining wall and a plurality of supporting uprights and, more particularly, to the construction of a bracket adapted for simultaneously and conjointly attaching a pool liner to the retaining wall and interlocking with an adjacent supporting upright.

Prefabricated pools of the type employing a flexible plastic liner and a relatively rigid metal retaining wall supported by vertical posts have enjoyed substantial acceptance in producing above-ground pools for use by families and organizations at a considerable lower cost and with considerable greater ease than possible with concrete or other masonry pools which generally extend substantially below ground. Above-ground pools have become increasingly popular over the past years and are now available in a wide variety of depths, sizes and shapes, including round and partially round configurations. These above-ground pools have the advantage over concrete or other masonry pools by being readily disassembled, by being portable to new locations, by being easily maintained over their lifetime, and by being easily repaired when required.

According to known above-ground pool constructions, the retaining wall is supported by a plurality of vertical supporting uprights spaced about its periphery. A series of rail members are arranged end-to-end about the top of the retaining wall and supported by the supporting uprights. It is conventional to attach the rail members to the supporting uprights with connecting hardware, such as a rail joint member. The plastic pool liner is secured over the upper edge of the retaining wall by means of a channel-shaped coping member, which itself is secured by means of the rail member. These structural components, i.e., retaining wall, supporting uprights, pool liner, channel-shaped coping member, rail members and rail joint members can be arranged to provide above-ground pools of various shapes and sizes.

Above-ground pools of the aforementioned type are typically purchased and assembled by the home do-it-yourselfer to provide recreation and leisure during the summer months. It is therefore of prime concern to the manufacturer that the assembling of the miscellaneous components of the pool be made as easy as possible, without the need of any particular expertise or specialized training. Unfortunately, the assembling of these pools has been inherently complicated in attempting to secure the pool liner to the retaining wall and the retaining wall to the supporting uprights by means of the channel-shaped coping member, rail members and rail joint members. For example, it has been found to be rather difficult for the unskilled do-it-yourselfer to secure the pool liner to the retaining wall while attempting to secure the retaining wall to the supporting upright. As a consequence, damage to the plastic pool liner can occur, as well as totally frustrating the home do-it-yourselfer.

Known above-ground pool constructions have taken a variety of forms and configurations. For example, the reader's attention is directed to any one of U.S. Pat. Nos. 3,268,917, 3,274,621, 3,518,705, 3,745,593, 3,785,099, 3,793,651 and 4,062,158. However, none of these pool constructions address the aforementioned problem associated with securing the plastic pool liner to the retaining wall and the retaining wall to the plurality of peripherally arranged supporting uprights.

SUMMARY OF THE INVENTION

It is broadly an object of the present invention to provide a swimming pool liner retaining bracket which overcomes or avoids one or more of the foregoing disadvantages resulting from the construction of the aforementioned above-ground swimming pools, and which meets the specific requirements of facilitating assembly of the miscellaneous components and members of such a swimming pool in a simple and uncomplicated manner.

Another object of the present invention is to provide a swimming pool liner retaining bracket which minimizes the time required for the installation of an above-ground swimming pool.

Another object of the present invention is to provide a swimming pool liner retaining bracket which is easy and economical to manufacture.

Another object of the present invention is to provide a swimming pool liner retaining bracket which improves the mechanical integrity and structural strength of the interconnected components and members of the above-ground pool.

In accordance with one embodiment of the present invention, there is provided a bracket for a pool having a retaining wall and a supporting upright. The bracket is constructed of a body having a first portion and a second portion constructed and arranged for simultaneously and conjointly attaching a pool liner to the upper edge of the retaining wall by means of the first portion and interlocking with an adjacent supporting upright by means of the second portion.

In accordance with another embodiment of the present invention, there is provided a swimming pool constructed of a retaining wall, a plurality of supporting uprights for the retaining wall, a pool liner received within the confines of the retaining wall, and a plurality of brackets, the brackets including a first portion and a second portion constructed and arranged for simultaneously and conjointly attaching the pool liner to the upper edge of the retaining wall by means of the first portion and interlocking with an adjacent upright by means of the second portion.

BRIEF DESCRIPTION OF THE DRAWINGS

The above description, as well as further objects, features and advantages of the present invention will be more fully understood by reference to the following detailed description of the presently preferred, but nonetheless illustrative, swimming pool liner retaining brackets in accordance with the present invention, when taken in conjunction with the accompanying drawings, wherein:

FIGS. 3–5 are perspective views showing the installation of the liner retaining bracket for simultaneously and conjointly attaching a pool liner to the upper edge of a retaining wall and interlocking with an adjacent supporting upright;

DETAILED DESCRIPTION

Figures 1, 2:
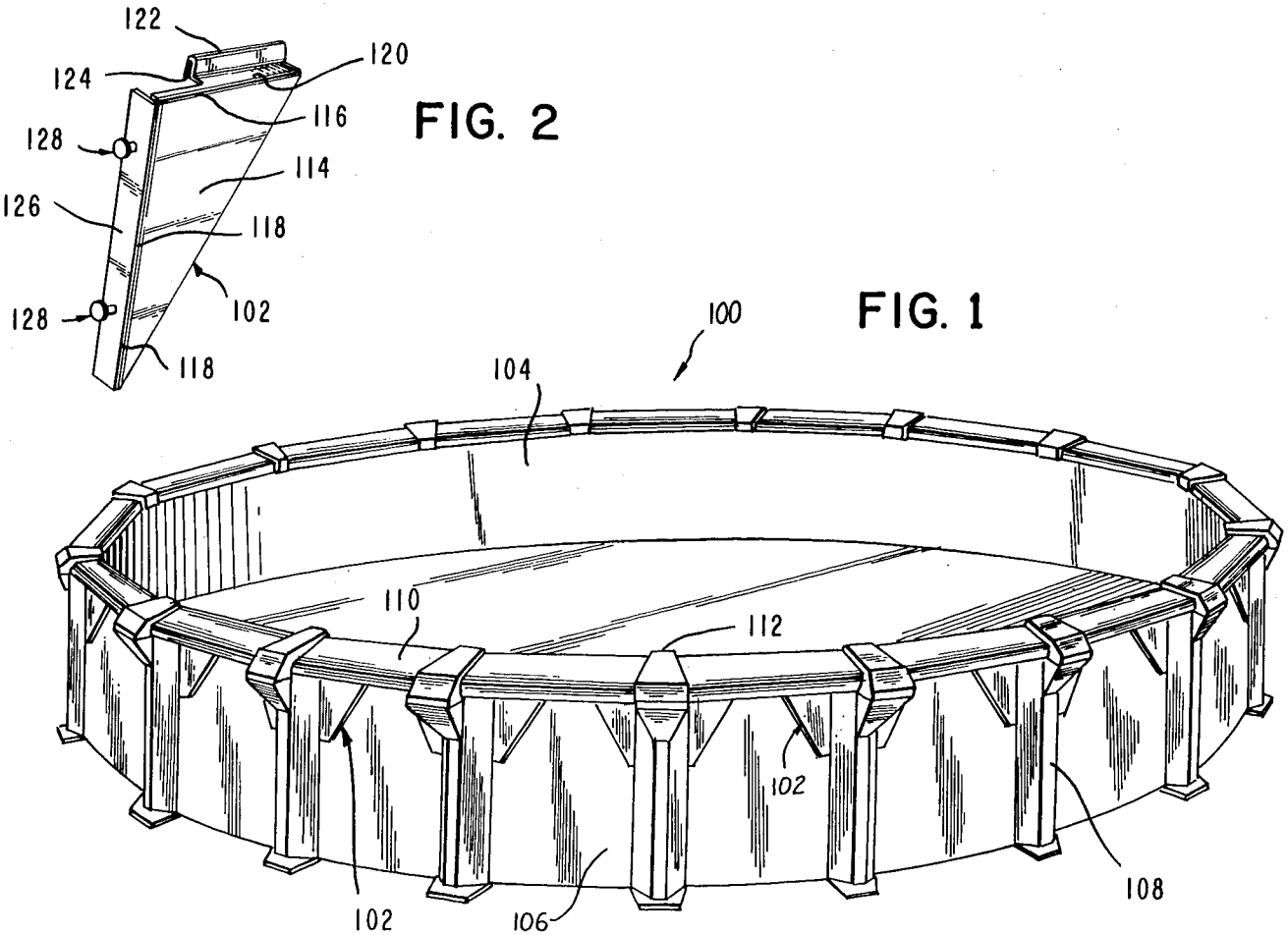
FIG. 1 is a perspective view, as shown from above, of an above-ground swimming pool including a plurality of liner retaining brackets constructed in accordance with the present invention.
FIG. 2 is a perspective view of a liner retaining bracket constructed in accordance with one embodiment of the present invention.

Referring now to the drawings, wherein like reference numerals represent like elements, there is shown in FIG. 1 an assembled above-ground swimming pool designated generally by reference numeral 100. The swimming pool 100 is assembled to include a plurality of liner retaining brackets constructed in accordance with the present invention and generally designated by reference numeral 102. The construction of the swimming pool 100 further includes a plastic pool liner 104, a rigid metal retaining wall 106, a plurality of supporting uprights 108, a plurality of rail members 110 and a plurality of rail caps 112. Except for the construction and installation of the liner retaining brackets 102, the construction and assembly of other individual components of the swimming pool 100 is generally in accordance with the teachings of known above-ground swimming pools. As such, the construction and assembling of these components, with the exception of the liner retaining bracket 102, will not be described hereat. To the extent that the reader may wish to become more versed in such construction and assembly techniques, the reader's attention is directed to any one of the aforementioned U.S. patents.

Referring now to FIG. 2, a liner retaining bracket 102 constructed in accordance with one embodiment of the present invention is shown. The liner retaining bracket 102 is constructed of a gusset 114 having a horizontal edge 116 and a vertical edge 118. A horizontal flange 120 extends from the horizontal edge 116 to form a right angle with the gusset 114. The horizontal flange 120, along its outer edge, is formed into a U-shaped member 122 having a downwardly facing opening 124. A vertical flange 126 extends from the vertical edge 118 at substantially a right angle thereto, as well as at a substantially right angle to the horizontal flange 120. A pair of projections 128 are attached in spaced-apart relationship to the vertical flange 126. Each projection 128, as shown in FIG. 3, is constructed of a post 130 extending from the vertical flange 126 and terminating at an enlarged head 132. As further shown in FIG. 3, the gusset includes an angled edge 134 from which there extends a side flange 136 arranged at a substantially right angle thereto.

The liner retaining bracket 102, as thus far described, is fabricated from a metal sheet, and being bent to form the component parts thereof as thus far described. The gusset 114 has been shown as triangular or wedge-shaped in nature. However, the shape of the gusset 114 is essentially non-functional and, in fact, has an artistic quality which provides the swimming pool 100 with a unique and novel look and overall appearance. Thus, the particular shape of the gusset 114 is non-essential to the present invention, and can be further shaped to have a rectangular, square, curved, articulated or other geometric shape or appearance and the like. The particular shape of the gusset 114 will, in turn, provide the swimming pool with a specific ornamental appearance as may be desired.

Turning now to FGS. 3–6, the assembling of the swimming pool 100 with respect to the use of the liner retaining bracket 102 will now be described. After initial setup of the retaining wall 106, supporting uprights 108 and pool liner 104, the swimming pool 100 with respect to such components will appear as shown in FIG. 3. The pool liner 104 will be secured to the upper edge of the retaining wall 106 by means of the liner retaining bracket 102 simultaneously and conjointly while securing the liner retaining bracket to the supporting upright 108. As shown in FIG. 3, the supporting upright 108 is provided with a pair of spaced-apart, keyhole-shaped openings 138 being registerable with the projections 128 extending outwardly from the vertical flange 126 of the liner retaining bracket 102. With the gusset 114 of the liner retaining bracket 102 arranged generally parallel to the outer surface of the retaining wall 106, the projections 128 are inserted into the upper enlarged openings of the keyhole-shaped openings 138 as provided on the supporting upright 108. As shown in FIG. 4, this arrangement results in the opening 124 of the U-shaped member 122 of the liner retaining bracket 102 overlying and being in registration with the upper edge of the retaining wall 106 about which a portion of the pool liner 104 has been folded over.

Referring to FIG. 5, the forceable downward movement of the liner retaining bracket 102 will result in the U-shaped member 122 capturing the upper edge of the retaining wall 106 along with the folded over portion of the pool liner 104. Simultaneously, the liner retaining bracket 102 will be secured to the supporting upright 108 by means of the projections 128 being secured by means of the keyhole-shaped openings 138 vis-a-vis the enlarged heads 132 provided on the extending posts 130 of the projections. As a result, the liner retaining bracket 102 simultaneously and conjointly attaches the pool liner 104 to the upper edge of the retaining wall 106 and interlocks with the adjacent supporting upright 108.

A liner retaining bracket 102 is attached on either side of each supporting upright 108 around the periphery of the swimming pool 100. Upon completion of the installation of the liner retaining brackets 102, the pool liner 104 along those locations between the supporting uprights 108 are attached to the upper edge of the retaining wall 106 by means of a channel-shaped coping member 140 having a downwardly facing slotted opening 142. The use of the liner retaining bracket 102, as thus far described, facilitates the attaching of the pool liner 104 to the retaining wall 106 while securing the retaining wall to an adjacent supporting upright 108. Previously, this assembly step was difficult to perform due to the nature of the construction of the brackets being used, as evident by the aforementioned patent, and often requiring the assistance of more than one person. To this end, the liner retaining bracket 102 provides for the simple and quick attachment of the pool liner 104 to the retaining wall 106 simultaneously and conjointly with the interlocking with an adjacent supporting upright 108.

Figure 6:
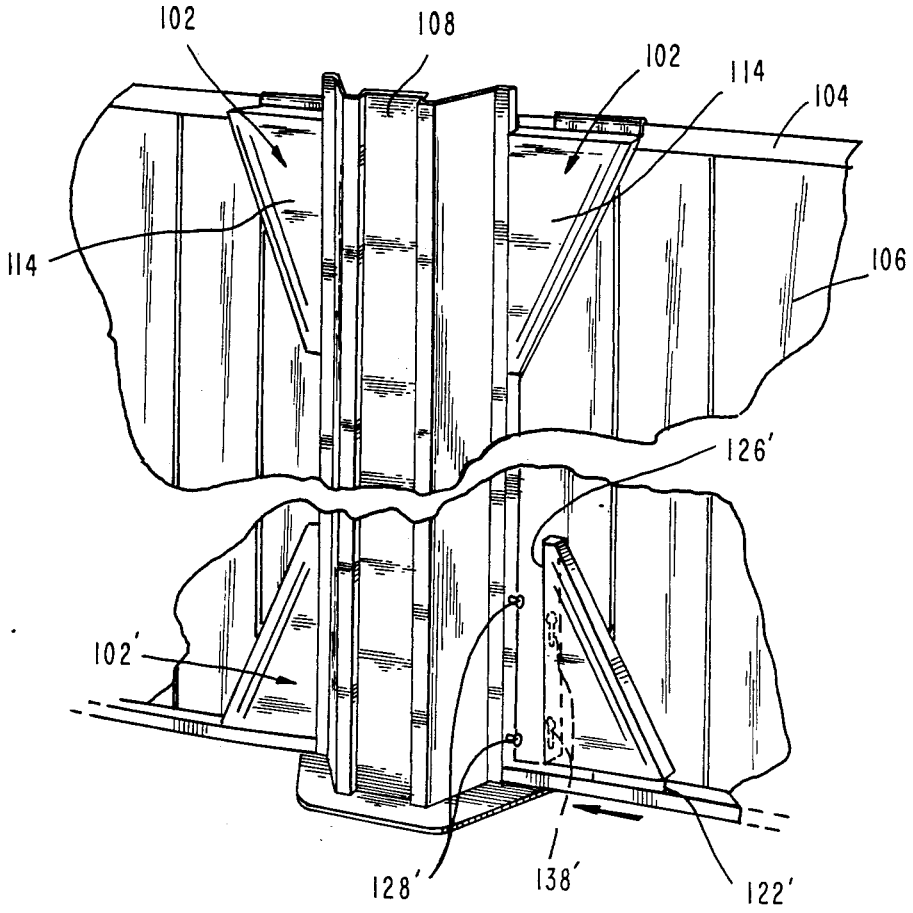
FIG. 6 is a perspective view of an assembled portion of an above-ground swimming pool and showing a liner retaining bracket constructed in accordance with a variation of the embodiment shown in the preceding figures.
Figure 7:
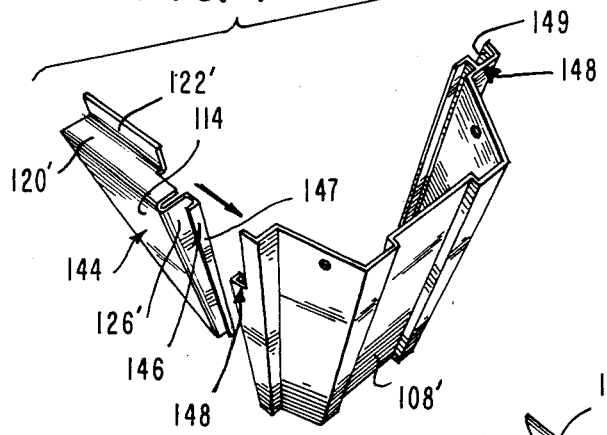
FIGS. 7–10 are perspective views showing a liner retaining bracket in accordance with another embodiment of the present invention and the installation of such liner retaining bracket for simultaneously and conjointly attaching a pool liner to the upper edge of a retaining wall and interlocking with an adjacent supporting upright.

Turning now to FIG. 6, a portion of a swimming pool 100 constructed in accordance with the present invention is illustrated. A pair of liner retaining brackets 102 are arranged adjacent either side of a supporting upright 108 for simultaneously and conjointly securing the pool liner 104 about the upper edge of the retaining wall 106 and interlocking with an adjacent portion of the supporting upright. The gussets 114 provide the swimming pool 100 with a unique ornamental look which also enhances the esthetic value of the liner retaining bracket 102. In addition, the liner retaining brackets 102 may be provided for securing the bottom portion of the retaining wall 106 to the supporting uprights 108 as shown. These additional and optional liner retaining brackets can be constructed in accordance with a variation of the thus far described embodiment of the present invention, and have been designated by reference numeral 102'.

The liner retaining brackets 102' are provided with keyhole-shaped openings 138' provided along the vertical flange 126'. The projections 128', on the other hand, are provided extending outwardly from the supporting upright 108. However, it is to be understood that these liner retaining brackets 102' may be constructed identically to the liner retaining bracket 102 illustrated in the preceding figures. Similarly, the liner retaining bracket 102 may be constructed in accordance with the liner retaining bracket 102'. In either event, the swimming pool 100 can be provided with a plurality of liner retaining brackets 102, 102' which are functional in nature and which further include ornamental features, i.e., gusset 114, which enhance the ornamental appearance of the swimming pool.

Turning now to FIGS. 7–10, there is disclosed another embodiment of a pool liner retaining bracket 144 in accordance with the present invention, wherein like reference numerals represent like elements. The liner retaining bracket 144 is provided with a U-shaped channel member 146 having a lip 147 and extending along the vertical edge 126'. A similar U-shaped channel member 148 having a lip 149 is provided along the upper lateral edges of the supporting upright 108'. The U-shaped channel members 146, 148 are adapted to mate and releasably interlock as to be described.

Figure 8:
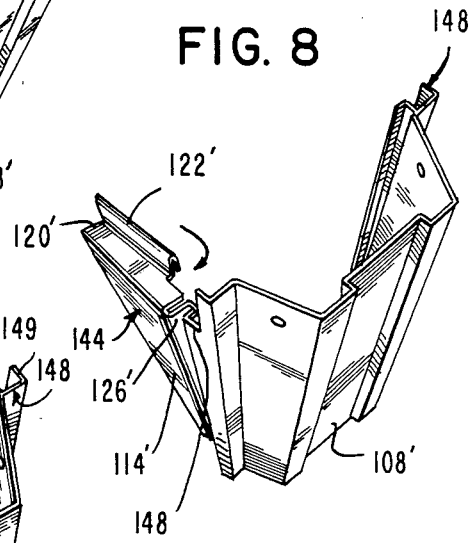
Figure 9:
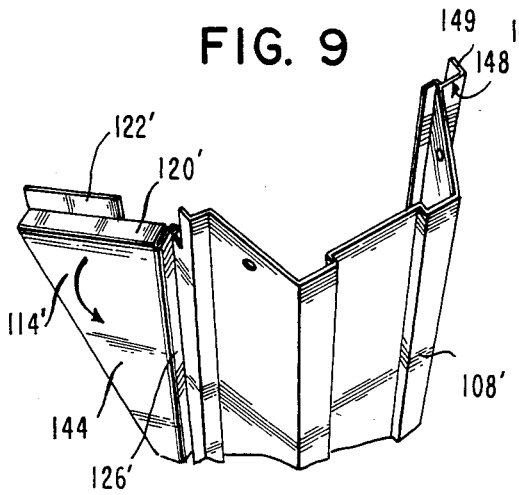
Figure 10:
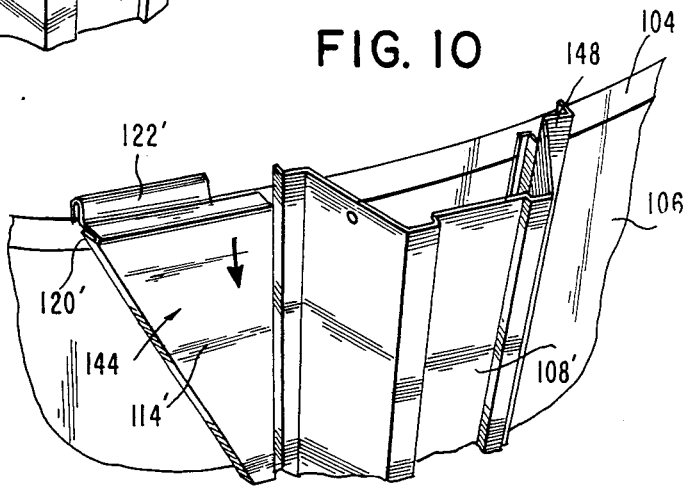

As shown in FIG. 8, the U-shaped channel member 146 of the liner retaining bracket 144 is engaged from behind with U-shaped channel member 148 of the supporting upright 108' which is positioned away from the outwardly facing surface of the retaining wall. The liner retaining bracket 144 is rotated forwardly, as shown in FIG. 9, to cause further engagement between the U-shaped channel members 146, 148 as to interlock via lips 147, 149 and the retaining bracket is positioned adjacent the outwardly facing surface of the retaining wall 106 along with the supporting upright. In this position, as shown in FIG. 10, the gusset 114' of the liner retaining bracket 144 is generally parallel to the surface of the retaining wall 106. In addition, the U-shaped member 122' is overlying the upper edge of the retaining wall 106 for engagement therewith upon the forcedly downward movement of the liner retaining bracket. The liner retaining bracket 144, as thus far described, functions in the same manner as the liner retaining brackets 102, 102'. In either case, the construction of the swimming pool 100 is completed using standard assembly techniques as previously known in the construction of above-ground swimming pools.

Although the invention herein has been described with reference to particular embodiments, it is to be understood that these embodiments are merely illustrative of the principles and application of the present invention. It is therefore to be understood that numerous modifications may be made to the illustrative embodiments and that other arrangements may be derived without departing from the spirit and scope of the present invention as defined by the appended claims.

What is claimed is:

1. In a swimming pool including a vertical retaining wall having an outwardly facing surface and an inwardly facing surface, said retaining wall having a horizontal edge portion, a pool liner overlying said inwardly facing surface of said retaining wall, and a vertical supporting upright having a vertical side edge portion, said supporting upright overlying the outwardly facing surface of said retaining wall, in combination with a bracket comprising a body having a substantially horizontal first portion and a substantially vertical second portion, said body positioned overlying and adjacent the outwardly facing surface of said retaining wall such that said horizontal first portion is arranged adjacent the horizontal edge portion of said retaining wall and said vertical second portion is arranged adjacent the vertical side edge portion of said supporting upright, said horizontal first portion and said vertical second portion constructed and arranged for simultaneously and conjointly attaching a pool liner to the horizontal edge portion of said retaining wall by means of said horizontal first portion and releasably interlocking with the adjacent vertical side edge portion of said supporting upright by means of said vertical second portion.

2. In the swimming pool of claim 1, wherein said vertical second portion of said body includes a channel member having an opening for receiving and engaging a portion of the vertical side edge of an adjacent supporting upright.

3. In the swimming pool of claim 1, wherein the vertical second portion of said body includes a projection for releasably engaging an opening providing within the vertical side edge of an adjacent supporting upright.

4. In the swimming pool of claim 1, wherein the vertical side edge of each supporting upright includes a projection for releasably engaging an opening provided within an adjacent vertical second portion of said body.

5. A swimming pool comprising a vertical retaining wall having an outwardly facing surface and an inwardly facing surface, said retaining wall having a horizontal edge portion, a plurality of vertical supporting uprights each having a vertical side edge portion, said supporting uprights overlying the outwardly facing surface of said retaining wall for the support thereof, a pool liner received within the confines of said retaining wall and partially supported by the inwardly facing surface thereof, and a plurality of brackets, said brackets including a substantially horizontal first portion and a substantially vertical second portion, each of said brackets positioned overlying and adjacent the outwardly facing surface of said retaining wall such that said horizontal first portion is arranged adjacent the horizontal edge portion of said retaining wall and said vertical second portion is arranged adjacent said vertical side edge portion of one of said supporting uprights, said horizontal first portion and said vertical second portion constructed and arranged for simultaneously and conjointly attaching said pool liner to the horizontal edge portion of said retaining wall by means of said horizontal edge portion and releasably interlocking with the adjacent vertical side edge portion of one of said supporting uprights by means of said vertical second portion.

6. The swimming pool of claim 5, wherein said vertical second portion of said body includes a channel member having an opening for receiving and engaging a portion of the vertical side edge of an adjacent supporting upright.

7. The swimming pool of claim 5, wherein the vertical second portion of said body includes a projection for releasably engaging an opening provided within the vertical side edge of an adjacent supporting upright.

8. The swimming pool of claim 5, wherein the vertical side edge of each supporting upright includes a projection for releasably engaging an opening provided within an adjacent vertical second portion of said body.

9. In a swimming pool including a vertical retaining wall having an outwardly facing and an inwardly facing surface, said retaining wall having a horizontal edge portion, a pool liner overlying said inwardly facing surface of said retaining wall, and a vertical supporting upright having a vertical edge portion, said supporting upright overlying the outwardly facing surface of said retaining wall, in combination with a bracket comprising a body having a substantially horizontal first portion and a substantially vertical second portion, said body positioned overlying the outwardly facing surface of said retaining wall such that said horizontal first portion is arranged adjacent the horizontal edge portion of said retaining wall and said vertical second portion is arranged adjacent the vertical edge portion of said supporting upright, said vertical second portion comprising a channel member arranged along a vertical edge of said body and having an opening for receiving and engaging a portion of the vertical edge portion of said supporting upright, said horizontal first portion and said vertical second portion constructed and arranged for simultaneously and conjointly attaching a pool liner to the horizontal edge portion of said retaining wall by means of said horizontal first portion and releasably interlocking with an adjacent vertical edge portion of said supporting upright by means of said vertical second portion.

10. In the swimming pool of claim 9 wherein said body comprises a gusset supporting said horizontal first portion and said vertical second portion.

11. In the swimming pool of claim 10, wherein said gusset is of triangular shape.

12. In the swimming pool of claim 9 wherein said horizontal first portion comprises a downwardly opening member arranged along a horizontal edge of said body for releasably engaging a portion of the horizontal edge portion of said retaining wall.

13. In the swimming pool of claim 9, wherein said vertical second portion comprises a projection assembly arranged along a vertical edge of said body for releasably engaging a portion of the vertical edge portion of an adjacent supporting upright.

14. In the swimming pool of claim 9 wherein said horizontal first portion comprises a downwardly opening member arranged along a horizontal edge of said body and having an opening receiving and engaging a portion of the horizontal edge portion of said retaining wall.

15. In the swimming pool of claim 9 wherein said body is of metal instruction.

16. In the swimming pool of claim 9 wherein said horizontal first portion and said vertical second portion are approximately arranged in a common plane.

17. In the swimming pool of claim 16, wherein said horizontal first portion and said vertical second portion are arranged substantially at a right angle to each other.

18. A swimming pool comprising a vertical retaining wall having an outwardly facing surface and an inwardly facing surface, said retaining wall having a horizontal edge portion, a plurality of vertical supporting uprights each having a vertical edge portion, said supporting uprights overlying the outwardly facing surface of said retaining wall for the support thereof, a pool liner received within the confines of said retaining wall and partially supported by the inwardly facing surface thereof, and a plurality of brackets, said brackets including a substantially horizontal first portion and a substantially vertical second portion, each of said brackets positionable overlying the outwardly facing surface of said retaining wall such that said horizontal first portion is arranged adjacent the horizontal edge portion of said retaining wall and said vertical second portion is arranged adjacent said vertical edge portion of one of said supporting uprights, said vertical second portion comprising a channel member arranged along a vertical edge of said bracket and having an opening for receiving and engaging a portion of the vertical edge portion of an adjacent supporting upright, said horizontal first portion and said vertical second portion constructed and arranged for simultaneously and conjointly attaching said pool liner to the horizontal edge portion of said retaining wall by means of said horizontal edge portion and releasably interlocking with an adjacent vertical edge portion of one of said supporting uprights by means of said vertical second portion.

19. The swimming pool of claim 18 wherein said bracket includes a gusset supporting said horizontal first portion and said vertical second portion.

20. The swimming pool of claim 19, wherein said gusset is of triangular shape.

21. The swimming pool of claim 18 wherein said horizontal first portion comprises a downwardly opening member arranged along a horizontal edge of said bracket for releasably engaging a portion of the horizontal edge portion of said retaining wall.

22. The swimming pool of claim 18, wherein said vertical second portion comprises a projection assembly arranged along a vertical edge of said bracket for releasably engaging a portion of the vertical edge portion of an adjacent supporting upright.

23. The swimming pool of claim 18 wherein said horizontal first portion comprises a downwardly opening member arranged along a horizontal edge of said bracket and having an opening receiving and engaging a portion of the horizontal edge portion of said retaining wall.

24. The swimming pool of claim 18, wherein said horizontal first portion and said vertical second portion are approximately arranged in a common plane.

25. The swimming pool of claim 24, wherein said horizontal first portion and said vertical second portion are arranged substantially at a right angle to each other.

* * * * *

UNITED STATES PATENT AND TRADEMARK OFFICE

CERTIFICATE OF CORRECTION

PATENT NO. : 4,847,926

DATED : July 18, 1989

INVENTOR(S) : Laputka

It is certified that error appears in the above-identified patent and that said Letters Patent is hereby corrected as shown below:

Column 2, line 45, between "adjacent" and "upright" insert --supporting--.
Column 4, line 50, "are" should read --is--.
Column 7, line 15, between "facing" and "and" insert --surface--.

Signed and Sealed this

Twenty-ninth Day of May, 1990

*Attest:*

HARRY F. MANBECK, JR.

*Attesting Officer*

*Commissioner of Patents and Trademarks*